United States Patent [19]

Umemura

[11] Patent Number: 4,470,384

[45] Date of Patent: Sep. 11, 1984

[54] DRIVE TRAIN FOR DISTRIBUTOR OF A SPARK IGNITION INTERNAL COMBUSTION ENGINE

[75] Inventor: Yasutoshi Umemura, Fuchu, Japan

[73] Assignee: Nissan Motor Company, Limited, Japan

[21] Appl. No.: 413,648

[22] Filed: Sep. 1, 1982

[30] Foreign Application Priority Data

Oct. 27, 1981 [JP] Japan ..... 56-170758

[51] Int. Cl.[3] ..... F02P 1/00

[52] U.S. Cl. ..... 123/146.5 A; 464/102

[58] Field of Search ..... 123/146.5 A, 146.5 R; 464/102, 104, 105

[56] References Cited

U.S. PATENT DOCUMENTS 2,238,649 4/1941 Kishline ..... 123/146.5 A

FOREIGN PATENT DOCUMENTS 2410312 9/1974 Fed. Rep. of Germany ... 123/146.5 A 2330171 1/1975 Fed. Rep. of Germany ... 123/146.5 A

OTHER PUBLICATIONS

Citroen GS Owner's Workshop Manual For 1015cc/1222cc Engines, Haynes Co., (1976).

*Primary Examiner*—Tony M. Argenbright

*Attorney, Agent, or Firm*—Leydig, Voit, Osann, Mayer and Holt, Ltd.

[57] ABSTRACT

A drive train for the distributor of a spark ignition internal combustion engine includes an engine camshaft having a hollow, a distributor shaft essentially parallel to the engine camshaft, and a coupling body disposed in the hollow of the engine camshaft. The coupling body is connected to the engine camshaft in such a manner that the coupling body will rotate along with the engine camshaft and can move relative to the engine camshaft in a radial direction. The coupling body is also connected to the distributor shaft in such a manner that the coupling body will rotate along with the distributor shaft and can move relative to the distributor shaft in a radial direction perpendicular to the direction of the radial movement of the coupling body relative to the engine camshaft. This connection of the distributor shaft to the engine camshaft causes them to rotate together and compensates for mis-alignment between the axes thereof.

4 Claims, 1 Drawing Figure

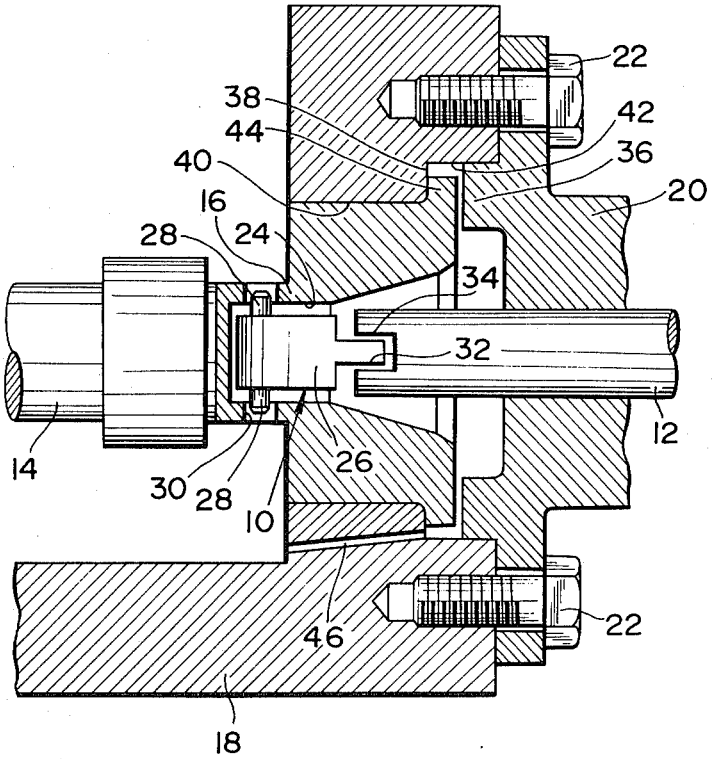
22
38
42
44
36
40
20
16
24
28
34
32
12
14
26
30
28
10
46
22
18

DRIVE TRAIN FOR DISTRIBUTOR OF A SPARK IGNITION INTERNAL COMBUSTION ENGINE

BACKGROUND OF THE INVENTION

1. Field of the Invention

This invention relates to a drive train for the distributor of a spark ignition internal combustion engine, and more particularly to an Oldham coupling which connects the distributor shaft to the engine camshaft.

2. Description of the Prior Art

Some spark ignition internal combustion engine distributors have drive shafts collinearly connected to engine camshafts by means of an Oldham coupling. For example, such a distributor train is disclosed in Owner's Workshop Manual, at page 47, for Citroen GS-type 1015 cc/1222 cc engines, published by Haynes Co. in 1976.

In this drive train, the Oldham coupling abuts the end face of the camshaft, so that the distributor projects from the end face of the engine cylinder head to a considerable extent and thus increases the total length of the engine. What is worse, the Oldham coupling is supported mainly by the distributor shaft which has a relatively small inertial moment, causing an increase in the precession, whip or whirl of the distributor shaft.

SUMMARY OF THE INVENTION

It is an object of this invention to provide an Oldham-coupling-equipped drive train for the distributor of a spark ignition internal combustion engine which has less influence on the total length of the engine.

Another object of this invention is to provide an Oldham-coupling-equipped drive train for an engine distributor which prevents precession, whip or whirl of the shaft of the distributor.

In accordance with this invention, a drive train for the distributor of a spark ignition internal combustion engine includes an engine camshaft having a hollow, a distributor shaft essentially parallel to the engine camshaft, and a coupling body disposed in the hollow of the engine camshaft. The coupling body is connected to the engine camshaft in such a manner that the coupling body will rotate along with the engine camshaft and can move relative to the engine camshaft in a radial direction. The coupling body is also connected to the distributor shaft in such a manner that the coupling body will rotate along with the distributor shaft and can move relative to the distributor shaft in a radial direction perpendicular to the direction of the radial movement of the coupling body relative to the engine camshaft. This connection of the distributor shaft to the engine camshaft causes them to rotate together and compensates for mis-alignment between the axes thereof.

The above and other objects, features and advantages of this invention will be apparent from the following description of a preferred embodiment thereof, taken in conjunction with the drawing.

BRIEF DESCRIPTION OF THE DRAWING

The drawing is a sectional view of a distributor train of this invention taken along a plane including the axes of an engine camshaft and a distributor shaft.

DESCRIPTION OF THE PREFERRED EMBODIMENT

With reference to the drawing, there is shown a drive train for the distributor of a spark ignition internal combustion engine according to this invention. The train includes an Oldham or slider coupling 10 which connects a distributor shaft 12 to an engine camshaft 14.

The camshaft 14 has a bossed end 16 which rotatably fits in a circular hole 40 through the wall of an end of engine cylinder head 18 to be rotatably supported by te cylinder head 18. The distributor shaft 12 rotatably passes through the center of the end of a distributor holder or casing 20 which is fixed by means of bolts 22 to the end of cylinder head 18 in such a manner as to oppose the camshaft end 16. The distributor shaft 12 is essentially parallel to the camshaft 14. The Oldham coupling 10 is disposed in a blind hollow or recess 24 of circular cross-section formed coaxially in the camshaft end 16. The hollow 24 extends from the end surface of the camshaft 14 to a position beyond the boss of the camshaft end 16. The distributor shaft 12 extends into the hole 40 and the hollow 24 to engage the Oldham coupling 10. Essentially, the camshaft 14, the distributor shaft 12, and the Oldham coupling 10 are axially aligned with each other.

The inside diameter of the hollow 24 decreases at a fixed rate from the entrance to an intermediate-depth point, and is constant from that point to the bottom. The Oldham coupling 10 includes a solid cylindrical body 26 of smaller outside diameter than the inside diameter of the constant-diameter portion of the hollow 24. The coupling body 26 is disposed predominantly in the constant-diameter portion of the hollow 24 and is substantially coaxial with the latter.

The coupling body 26 has a pair of diametrically-opposed radial pins 28 of circular cross-section at its periphery near the end opposing the bottom of the hollow 24. The camshaft end 16 has a diametrical circular hole 30 at such a position that the hole 30 crosses the hollow 24 near the bottom thereof and that the hole 30 is slightly distant from the boss of the camshaft end 16. The inside diameter of the hole 30 is slightly greater than the outside diameter of the pins 28. The pins 28 align with the hole 30 and extend out of the hollow 24 to slideably fit in the wall of the camshaft end 16 defining the hole 30. The pins 28 support the coupling body 26 on the camshaft end 16 in such a manner that the coupling body 26 will rotate along with the camshaft 14 and that it can move relative to the camshaft 14 in the direction of the axis of the hole 30, that is, in a radial direction or the direction perpendicular both to the axes of the camshaft 14 and the coupling body 26. The radial gap between the coupling body 26 and the camshaft 14 is chosen to ensure sufficient radial movement of the coupling body 26 relative to the camshaft 14.

The coupling body 26 also has an axial key tongue or projection 32 on the end facing the distributor shaft 12. The projection 32 extends diametrically in a direction perpendicular to the axis of the pins 28 and is considerably narrower than the outside diameter of the coupling body 26. The projection 32 terminates within the tapered portion of the hollow 24. The end surface of the distributor shaft 12 is in the tapered portion of the hollow 24 and is provided with a diametrical key slot 34 slightly wider than the projection 32. The projection 32 fits in the slot 34, so that the coupling body 26 engages the distributor shaft 12 to cause it to rotate along with the coupling body 26. The inside diameters of the tapered portion of the hollow 24 accommodating the distributor shaft 12 are greater than the outside diameter of the distributor shaft 12, so that the distributor shaft 12 can engage the coupling body 26 even when the axes of the distributor shaft 12 and the camshaft 14 mis-align with one another to some extent. The projection 32 can slide along the slot 34, so that the coupling body 26 can move relative to the distributor shaft 12 in a radial direction perpendicular to the direction of the permitted radial movement of the coupling body 26 relative to the camshaft 14.

The coupling body 26, the pins 28, the projection 32, the hole 30, and the slot 34 thus constitute the Oldham coupling 10 which transmits torque from the camshaft 14 to the distributor shaft 12 while compensating for mis-alignment between the parallel axes thereof in a well-known manner.

The end surface of the distributor casing 20 opposing the camshaft end 16 is formed with an axially extending annular portion 36 which snugly fits into the hole 40. The inner surface of the cylinder head 18 defining the hole 40 is formed with an annular step 38 opposing the annular portion 36. The annular step 38 and the annular portion 36 form an annular groove 42, which accommodates a radial annular flange 44 formed on the edge of the boss of the camshaft end 16. The annular step 38, the annular portion 36, and the flange 44 constitute a thrust bearing for the camshaft 14. A lubricant return passage 46 opening to the annular groove 42 is provided through the wall of the end of cylinder head 18.

Since the Oldham coupling 10 is disposed in the hollow 24, the distributor (not shown) can be mounted closer to the end of cylinder head 18 than in the conventional case and thus the total length of the engine can be reduced. The coupling body 26 is supported mainly by the camshaft 14 via the pins 28, so that precession, whip or whirl of the distributor shaft 12 can be reduced as compared to the conventional case. Since the inertial moment of the camshaft 14 is relatively great, the coupling body 26 has essentially no influence on the rotation of the camshaft 14.

A pair of radial pins may be provided on the camshaft 14 instead of the coupling body 26. In this case, a hole receiving the pins should be provided in the coupling body 26 instead of the camshaft 14.

A diametrical key slot may be provided in the end of the coupling body 26. In this case, a projection fitting in the key slot should be provided on the end of the distributor shaft 12 instead of the coupling body 26.

It should be understood that further modifications and variations may be made in this invention without departing from the spirit and scope of this invention as set forth in the appended claims.

What is claimed is:

1. A drive train for the distributor of a spark ignition internal combustion engine, comprising:

(a) an engine camshaft having a hollow;

(b) a distributor shaft essentially parallel to the engine camshaft;

(c) a coupling body disposed in the hollow of the engine camshaft;

(d) first means for connecting the coupling body to the egine camshaft in such a manner that the coupling body will rotate along with the engine camshaft and that the coupling body can move relative to the engine camshaft in a radial direction; and (e) second means for connecting the coupling body to the distributor shaft in such a manner that the coupling body will rotate along with the distributor shaft and that the coupling body can move relative to the distributor shaft in a radial direction perpendicular to the direction of the radial movement of the coupling body relative to the engine camshaft;

(f) whereby the engine camshaft and the distributor shaft will rotate together while mis-alignment between the axes thereof is compensated.

2. A drive train as recited in claim 1, wherein the first means includes a pair of diametrically-opposed radial holes formed in the camshaft, and a pair of diametrically-opposed radial pins formed on the coupling body, the radial holes crossing the hollow of the engine camshaft, the radial pins aligning with the radial holes and each slideably fitting in the engine camshaft defining each radial hole.

3. A drive train as recited in claim 1 or 2, wherein the second means includes a diametrical slot formed at the end surface of the distributor shaft, and a diametrical projection on the coupling body, the projection slideably fitting in the diametrical slot.

4. A drive train as recited in claim 3, wherein the hollow of the engine camshaft is at the end thereof and is of circular cross-section coaxial with the engine camshaft, and wherein the coupling body is in the form of a solid cylinder extending axially with respect to the engine camshaft.

* * * * *